US006179220B1

(12) United States Patent
Kolkman et al.

(10) Patent No.: US 6,179,220 B1
(45) Date of Patent: Jan. 30, 2001

(54) FUEL INJECTION APPARATUS

(75) Inventors: Manfred Kolkman, Messancy (BE); Hermann Breitbach, Crauthem (LU)

(73) Assignee: Delphi Technologies, Inc., Troy, MI (US)

( * ) Notice: Under 35 U.S.C. 154(b), the term of this patent shall be extended for 0 days.

(21) Appl. No.: 09/408,052

(22) Filed: Sep. 29, 1999

(30) Foreign Application Priority Data

Oct. 16, 1998 (DE) ..... 198 47 839

(51) Int. Cl.[7] ..... F02M 47/02
(52) U.S. Cl. ..... 239/91; 239/124; 239/585.1
(58) Field of Search ..... 239/124, 88, 89, 239/90, 91, 95, 585.1, 585.3, 533.5, 533.3

(56) References Cited

U.S. PATENT DOCUMENTS

| | | | | |
|---|---|---|---|---|
| 3,680,782 | * | 8/1972 | Monpetit et al. | 239/96 |
| 3,737,100 | * | 6/1973 | Dreisin | 239/89 |
| 4,360,163 | * | 11/1982 | Williams | 239/533.5 |
| 5,011,082 | * | 4/1991 | Ausiello et al. | 239/124 |
| 5,779,149 | * | 7/1998 | Hayes, Jr. | 239/124 |

FOREIGN PATENT DOCUMENTS

| | | |
|---|---|---|
| 4446269 | 6/1996 | (DE) . |
| 19624001 | 12/1997 | (DE) . |
| 19740997 | 3/1998 | (DE) . |
| 19738351 | 5/1998 | (DE) . |
| 0753659 | 1/1997 | (EP) . |
| 0798459 | 1/1997 | (EP) . |

* cited by examiner

*Primary Examiner*—Andres Kashnikow
*Assistant Examiner*—Dinh Q. Nguyen
(74) *Attorney, Agent, or Firm*—John A. VanOphem

(57) ABSTRACT

The invention relates to a fuel injection apparatus, in particular for diesel engines, comprising at least one injection nozzle which is connected to a fuel pressure line and which has a nozzle element which can be actuated through a control unit for the opening and the closing of the injection nozzle, with the control unit comprising a piston which is displaceably journalled in a control passage, which is coupled at its one end to the nozzle element and which bounds with its other end together with a plug which is arranged in the control passage a pressure chamber which can be connected up to the fuel pressure line via a supply passage and which communicates with an outflow passage, with it being possible to vary the pressure in the pressure chamber through the release or the interruption of the flow through the outflow passage for the actuation of the nozzle element when the pressure chamber is connected via the supply passage to the fuel pressure line, and with it being possible to influence the flow through the supply passage into the pressure chamber and the flow out of the pressure chamber into the outflow passage through a displacement of the piston as a result of a pressure change in the pressure chamber.

21 Claims, 1 Drawing Sheet

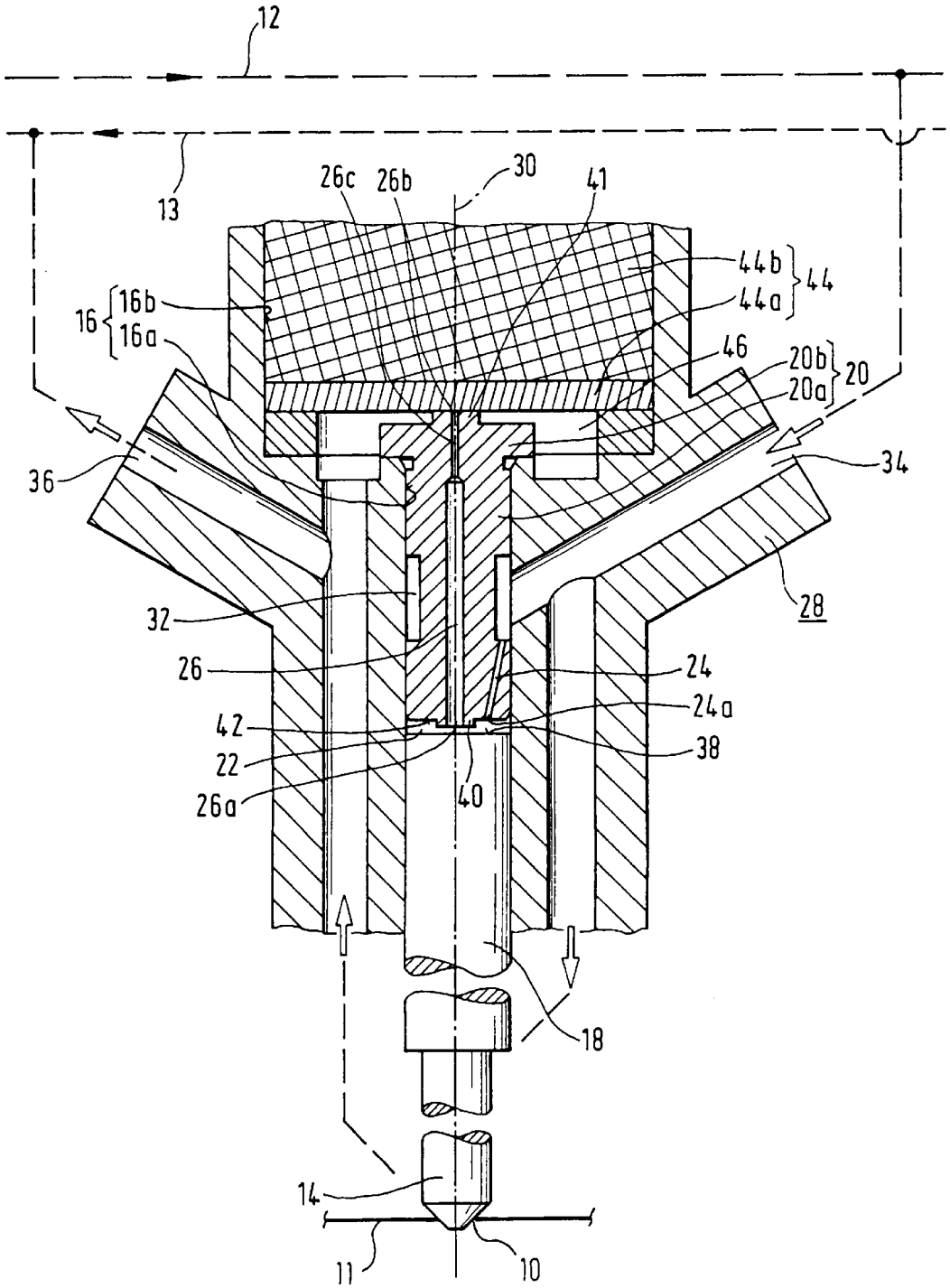
12
13
26c
26b
30
41
44b
44a
44
16
16b
16a
46
20b
20a
20
36
34
28
32
26
24
24a
42
38
22
26a
40
18
14
11
10

FUEL INJECTION APPARATUS

TECHNICAL FIELD

The invention relates to a fuel injection apparatus, in particular for diesel engines, comprising at least one injection nozzle which is connected up to a fuel pressure line and which has a nozzle element which can be actuated through a control unit for the opening and the closing of the injection nozzle.

BACKGROUND OF THE INVENTION

Injection apparatuses of this kind are known in principle and serve for the supplying at the proper time point of a specific amount of fuel, which is injected under high pressure directly into the cylinder in a diesel engine, to the combustion chamber of a cylinder which is associated with the injection nozzle.

The objective of this invention is to provide as simply constructed a fuel injection apparatus of the initially named kind as possible which enables an ideal actuation of the nozzle element and which can be adapted in the simplest possible way to different requirements.

SUMMARY OF THE INVENTION

This object is satisfied in accordance with the invention by the features of claim 1 and in particular in that the control unit comprises a piston which is displaceably journalled in a control passage, which is coupled at its one end to the nozzle element and which bounds with its other end together with a plug which is arranged in the control passage a pressure chamber which can be connected to the fuel pressure line via a supply passage and which communicates with an outflow passage; in that the pressure in the pressure chamber can be varied through the release or the interruption of the outflow passage for the actuation of the nozzle element when the pressure chamber is connected via the supply passage to the fuel pressure line; and in that the flow through the supply passage into the pressure chamber and the flow out of the pressure chamber into the outflow passage can be influenced through a displacement of the piston as a result of a pressure change in the pressure chamber.

In accordance with the invention the force acting on the piston and thus on the nozzle element which is coupled to the piston can be varied through a variation of the pressure in the pressure chamber in such a manner that it is either greater or less than the force which acts on the piston via the nozzle element of the injection nozzle which is connected up to the fuel pressure line. In dependence on the magnitude of the pressure in the pressure chamber the injection nozzle is thus opened or closed.

The temporal behaviour of the pressure variation in the pressure chamber is dependent on the flow relationships in the flow path from the fuel pressure line into the pressure chamber, from the outlet opening of the supply passage through the pressure chamber to the inlet opening of the outflow passage and through the outflow passage. Through a variation of the geometrical relationships in the pressure chamber, in particular the size of the inlet opening, the size of the outlet opening and/or of the axial distance between the inlet opening and the outlet opening, the fuel injection apparatus in accordance with the invention can be adapted to different requirements in a simple way.

In the fuel injection apparatus in accordance with the invention both the supply passage and the outflow passage are in connection with the pressure chamber. This enables the geometry of the pressure chamber to be designed in such a manner that when the injection nozzle opens, the piston which moves in the direction of the plug simultaneously reduces the flow cross-sections in the region of the outlet opening of the supply passage and the inlet opening of the outflow passage. In this way the intake and the outlet of the pressure chamber can be throttled at the same time. This functional principle is designated as the STOP principle (Simultaneously Throttled Orifice Principle).

The fuel injection apparatus in accordance with the invention can be used in conjunction with multiple cylinder engines in such a manner that a control unit which is designed in accordance with the invention is associated with each injection nozzle and the injection nozzles are connected up to a common fuel pressure line. An arrangement of this kind is also designated as a "common rail injector" or a "common rail injection".

In accordance with a preferred exemplary embodiment of the invention the supply passage and the outflow passage are in each case formed at least region-wise in the plug.

Through this it is enabled to provide a simply constructed piston and to determine the geometry of the pressure chamber substantially through the shape of the plug. Thus, for the adaptation of the injection apparatus to different requirements, the plug need merely be replaced in order to enable the respective desired type and manner of the variation of the pressure.

In accordance with a further preferred embodiment of the invention the injection nozzle is connected via a supply line to the fuel pressure line and is connected up to an outflow line, with the supply passage being connected at the supply line and the outflow passage at the outflow line, and with the supply line, the outflow line and the control passage being formed in a connector piece.

Through this a particularly simple construction of the injection apparatus in accordance with the invention results.

In accordance with a further preferred exemplary embodiment of the invention it is provided that the supply passage and the outflow passage in each case open into the pressure chamber at an end side of the plug facing the piston at regions which have a different axial distance from an end side of the piston facing the plug.

The difference in the axial distance of the openings of the supply passage and of the outflow passage, i.e. of an outlet opening of the supply passage and of an inlet opening of the outflow passage, from the end side of the piston has as a result that, when the outflow passage is released for the opening of the injection nozzle and when the piston moves in the direction towards the plug, the throttling of the fuel flows through the outlet opening and the inlet opening begin at different time points. The flows through the outlet opening and through the inlet opening can be throttled at the same time in this manner, with however the extent of the throttling being of different magnitudes at the same times.

The ratio of the extent of the two throttlings with respect to one another is in this dependent on the size of the distance between the outlet opening and the inlet opening. At a large distance the flow through the opening which lies closer to the end side of the piston facing the plug is more strongly throttled than the flow through the other opening. In contrast, in the case of a small distance the throttlings of the two flows take place in substantially the same manner.

The temporal behaviour of the pressure variation in the pressure chamber is determined by the ratio of the amount of fuel flowing per unit time through the two openings, i.e.

out of the supply passage into the pressure chamber and via the outflow passage out of the pressure chamber, and can thus be determined in the desired manner through the corresponding choice of the difference between the axial distances of the inlet opening and the outlet opening from the end side of the piston.

In accordance with a further embodiment of the invention it is provided that the supply passage and the outflow passage open into the pressure chamber in each case at an end side of the plug facing the piston at regions which are spaced with respect to one another in the axial direction, with a planar end side of the piston facing the plug preferably extending substantially perpendicular to a longitudinal axis of the piston, which preferably coincides with the longitudinal axis of the control unit.

Through this the throttling ratio is determined by the axial distance between the outlet opening of the supply passage and the inlet opening of the outflow passage. Thus for the adaptation of the injection apparatus in accordance with the invention to different requirements, a plug having the respective suitable geometry need merely be arranged in the control passage.

In accordance with a further preferred embodiment of the invention an end side of the plug facing away from the piston and an actuation element which is displaceably journalled in the control passage bound an actuation chamber which in particular communicates with an outflow line for the injection nozzle, with the outflow passage opening into the actuation chamber and with it being possible to release or close off an outlet opening of the outflow passage which is formed in the end side of the plug pointing away from piston through a displacement of the actuation element.

In this the actuation of the nozzle element for the opening and closing of the injection nozzle follows simply through a displacing of the actuation element, which for example can be designed as a magnetically actuatable hydraulic valve.

Further embodiments of the invention are set forth in the subordinate claims, in the description and in the drawings.

BRIEF DESCRIPTION OF THE DRAWINGS

The present invention will now be described, by way of example, with reference to the accompanying drawings, in which:

FIG. 1 is a lateral sectional view of a partly illustrated fuel injection apparatus in accordance with an embodiment of the invention.

DESCRIPTION OF THE PREFERRED EMBODIMENT

The fuel injection apparatus in accordance with the invention comprises an injection nozzle, of which a nozzle element, which is designed as a nozzle needle 14 and which either closes off—as illustrated in the figure—or releases an injection opening 10 in dependence on its position in the direction of a longitudinal axis 30, is illustrated in the figure. The injection opening 10, which leads to a combustion chamber of a cylinder of a diesel engine (not shown), is formed in a housing 11 which surrounds the nozzle needle 14 and of which merely a region extending perpendicular to the nozzle needle 14 is indicated in the figure.

A connector piece 28 which is designed in a single piece, and via which the injection nozzle is connected up in a manner which will be explained in more detail below to a fuel pressure line 12 which is drawn in broken lines, is associated with the injection nozzle.

A control unit which will be described below and which comprises substantially the connector piece 28, a piston 18, a plug 20 and an actuation element 44, serves for the opening and closing of the injection opening 10 through the moving of the nozzle needle 14 in the axial direction parallel to a longitudinal axis 30 of the control unit.

A supply line 34 is formed in the connector piece 28 via which the injection nozzle is connected up to the fuel pressure line 12. Furthermore, the injection nozzle is connected to an outflow line 36 which is likewise formed in the connector piece 28 and which leads via a fuel return line 13 to a non-illustrated fuel tank of the vehicle.

Furthermore, a control passage 16 is formed in the connector piece 28 which has a piston region **16*a* which merges at its end pointing away from the nozzle needle 14 into an actuation region 16*b* with a cross-section which is enlarged relative to the piston region 16*a***.

The cylindrical piston 18 is arranged in the piston region **16*a* of the control passage 16, is connected to the nozzle needle 14** and is displaceable in the axial direction.

The plug 20 is fitted in with a plugging section **20*a* in a sealed off manner into the piston region 16*a* of the control passage 16 and is held by frictional forces in the control passage 16, i.e. in the connector piece 28. Furthermore, the plug 20 is braced with a holder section 20*b* at a region of the connector piece 28 which bounds the opening of the piston region 16*a* into the actuation region 16*b***.

A ring cut-out 32 which forms an inlet chamber on the outer wall of the plug 20 is connected up to the supply line 34 which is formed in the connector piece 28 and is in connection via a supply passage 24 which is formed in the plug 20 with a pressure chamber 22, which is bounded by the inner wall of the control passage 16 and the mutually facing end sides of the plug 20 and of the piston 18. The supply passage 24 opens into the pressure chamber 22 via an outlet opening **24*a* which is formed in the end side of the plug 20 facing the piston 18**.

In deviation from the illustrated embodiment the supply passage 24 can also—starting from the ring cut-out 32—first have a section with a smaller flow cross-section extending at an inclination to the longitudinal axis 30 which merges into a section with a larger flow cross-section which e.g. extends parallel to the longitudinal axis 30 and opens via the outlet opening **24*a* into the pressure chamber 22**.

Furthermore, an outflow passage 26 is formed in the plug 20, the longitudinal axis of which coincides with the longitudinal axis 30 of the control unit and communicates with the pressure chamber 22 at a central extension 40 of the plug 20 having a circular cross-section via an inlet opening **26*a***.

The outlet opening **24*a* of the supply passage 24 is formed in a circular region 42 of the end side of the plug 20 facing the piston 18 which is lowered relative to the extension 40 and which surrounds the extension 40**.

As a result the outlet opening **24*a* of the supply passage 24 and the inlet opening 26*a* of the outflow passage 26 are spaced with respect to one another in the axial direction, i.e. in the direction of the longitudinal axis 30, so that they have a different axial distance from the planar end side 38 of the piston 18 facing the plug 20 which extends perpendicular to the longitudinal axis 30**.

At the end side of the holder section **20*b* of the plug 20 pointing away from the piston 18 a further central extension 41 with a circular cross-section is formed in which an outlet opening 26*b* of the outflow passage 26 is formed. In the region ahead of the outlet opening 26*b*** the outflow passage 26 has a constriction or throttle point 26*c*, the length of which is about one fifth of the total length of the outflow passage 26.

On the side of the plug 20 lying opposite to the piston 18 the actuation element, which is designed as a magnetically actuatable hydraulic valve 44, is provided in the actuation region 16*b* of the control passage 16 and is journalled displaceably in the direction of the longitudinal axis 30 in the control passage 16. The valve 44 has a control armature 44*a* facing the plug 20 which is connected to a magnet arrangement 44*b*.

The plug 20, the valve 44 and the control passage 16 bound an actuation chamber 46 which is connected up to the outflow line 36 which is formed in the connector piece 28. In the state illustrated in the figure the outlet opening 26*b* of the outflow passage 26 is closed off by the control armature 44*a* of the valve 44.

When the valve 44 is lifted, i.e. moved away from the plug 20, the outflow passage 26 communicates as a result with the actuation chamber 46 so that a flow connection from the pressure chamber 22 to the fuel tank of the vehicle exists via the outflow passage 26, the actuation chamber 46 and the outflow line 36.

The method of functioning of the fuel injection apparatus in accordance with the invention is as follows:

When the outflow passage 26 is closed off by the valve 44 in accordance with the state illustrated in the figure the pressure of the fuel pressure line 12 is present in the pressure chamber 22. The area of the end side 38 of the piston 18 facing the plug 20 is dimensioned in such a manner that the force acting on the piston 18 which attempts to move the piston 18 away from the plug 20 is greater than the force which acts on the piston 18 via the nozzle needle 14 of the injection nozzle, which is likewise connected up to the fuel pressure line 12. When the outflow passage 26 is closed, the injection opening 10 of the injection nozzle is closed off as a result by the nozzle needle 14.

In order to lift the nozzle needle 14 for the release of the injection opening 10 the valve 44 is excited by a non-illustrated control device in order to move away from the plug 20 and to release the flow connection through the outflow passage 26. Through this the pressure chamber 22 is connected to the outflow line 36 so that as a result of the fuel flowing off through the outflow passage 26 the pressure in the pressure chamber 22 and thus the force acting on the piston 18 from the pressure chamber 22 decreases.

The outflow passage 26 is dimensioned in such a manner that the pressure drop is sufficient in order to move the piston 18 through the force acting on it from the injection nozzle in the direction of the plug 20. Through this the nozzle needle 14 is lifted and the injection opening 10 is released so that the injection process begins.

The inlet opening 26*a* of the outflow passage 26 lies closer to the end side 38 of the piston 18, which moves in the direction towards the plug 20, than the outlet opening 24*a* of the supply passage 24. Therefore the flow through the inlet opening 26*a* is already throttled as a result of the reduction in the flow cross-section between the extension 40 which borders the inlet opening 26*a* of the outflow passage 26 and the end side 38 of the piston 18 at a time point at which the flow via the supply passage 24 into the pressure chamber 22 is not yet influenced by the piston 18.

As a result the pressure in the pressure chamber 22 increases again from the time point at which the amount of fuel flowing in per unit time becomes greater than the amount of fuel flowing off during the same time interval.

In an axial position of the piston 18 in the control passage 16, which is in particular determined by the axial distance between the outlet opening 24*a* and the inlet opening 26*a*, a state of equilibrium is reached in which the ratio between the inflowing and the outflowing fuel amount corresponds to a pressure in the pressure chamber 22 which just compensates the force acting on the piston 18*a* via the nozzle needle 14.

In dependence on the geometrical relationships, in particular on the axial distance between the outlet opening 24*a* and the inlet opening 26*a*, a throttling of the flow through the outlet opening 24*a* of the supply passage 24 can also take place prior to the achieving of the equilibrium state. This sets in later than the throttling of the flow through the inlet opening 26*a* of the outflow passage 26 as a result of the greater axial distance between the outlet opening 24*a* and the end side 38 of the piston 18.

In the mentioned equilibrium position of the piston 18 it is not a matter of a static state, but rather the piston 18 executes oscillations about its equilibrium position.

The frequency and the amplitude of these oscillations are in particular dependent on the axial distance between the outlet opening 24*a* of the supply passage 24 and the inlet opening 26*a* of the outflow passage 26. In this a large axial distance leads to low frequencies with large amplitudes, whereas the result in the event of a small axial distance are high frequencies and low amplitudes.

When the flow through the outflow passage 26 is again interrupted through a closing of the outflow opening 26*b* by means of the valve 44, the pressure in the pressure chamber 22 increases so that the piston 14 is moved away from the plug 20 and the injection opening 10 through the nozzle needle 14 is again closed off. At this time point the injection process is ended.

Since the forces acting on the piston 18 and thus the nozzle needle 14—with the exception of the mentioned oscillations—cancel each other in the equilibrium state, the nozzle needle 14 responds very rapidly to a closing off of the outlet opening 26*b* and the thereby produced pressure increase in the pressure chamber 22 so that the injection opening 10 of the injection nozzle can be closed nearly without delay.

As a result an after-dripping of the injection nozzle is effectively prevented through the fuel injection apparatus in accordance with the invention.

What is claimed is:

1. Fuel injection apparatus comprising at least one injection nozzle (10, 11, 14) which is connected to a fuel pressure line (12) and which has a nozzle element (14) which can be actuated through an electrically actuable control unit (18, 20, 28, 44) for the opening and the closing of the injection nozzle (10, 11, 14), with the control unit (18, 20, 28, 44) comprising a piston (18) displaceably journalled in a control passage (16), and coupled at one end to the nozzle element (14) and which bounds with an outer end together with a plug (20) which is arranged in the control passage (16), a pressure chamber (22) which can be connected to the fuel pressure line (12) via a supply passage (24) and communicates with an outflow passage (26), such that the supply passage (24) and the outflow passage (26) are in each case at least region-wise formed in the plug (20), whereby, for the actuation of the nozzle element (14) when the pressure chamber (22) is connected via the supply passage (24) to the fuel pressure line (12), the pressure in the pressure chamber (22) is varied through the release or the interruption of the flow through the outflow passage (26), and whereby a displacement of the piston (18) as a result of a pressure change in the pressure chamber (22) influences the flow through the supply passage (24) into the pressure chamber (22) and the flow out of the pressure chamber (22) into the outflow passage (26).

2. Injection apparatus in accordance with claim 1, wherein the injection nozzle (10, 11, 14) is connected via a supply line (34) to the fuel pressure line (12) and is connected up to an outflow line (36), with the supply passage (24) being connected up to the supply line (34) and the outflow passage (26) to the outflow line (36).

3. Injection apparatus as claimed in claim 1, wherein a supply line (34), an outflow line (36) and the control passage (16) are formed in a connector piece (28).

4. Injection apparatus as claimed in claim 1 wherein the supply passage (24) extends at least region-wise at an inclination to the longitudinal axis of the plug (20), which coincides with a longitudinal axis (30) of the control unit (18, 20, 28, 44), through the plug (20) and preferably opens into an inlet chamber which is formed in the plug (20) and which communicates with a supply line (34).

5. Injection apparatus as claimed in claim 1 wherein the outflow passage (26) extends in the axial direction through the plug (20), with the longitudinal axis of the outflow passage (26) coinciding with the longitudinal axis of the plug (20).

6. Injection apparatus as claimed in claim 1 wherein the supply passage (24) and the outflow passage (26) in each case open into the pressure chamber (22) at an end side of the plug (20) facing the piston (18) at regions which are spaced apart in the axial direction, with a planar end side (38) of the piston (18) facing the plug (20) and extending perpendicular to a longitudinal axis of the piston (18).

7. Injection apparatus as claimed in claim 1 wherein the outflow passage (26) opens into the pressure chamber (22) in the region of a central extension (40) having a circular cross-section and the supply passage (24) opens into the pressure chamber (22) at an annular region of an end side of the plug (20) facing the piston (18) which is stepped below to the extension (40) and which surrounds the extension (40).

8. Injection apparatus as claimed in claim 1 wherein an end side of the plug (20) pointing away from the piston (18) and an actuation element (44) which is displaceably journalled in the control passage (16) bound an actuation chamber (46) which communicates with an outflow line (36) for the injection nozzle (10, 11, 14), with the outflow passage (26) opening into the actuation chamber (46) and with the plug (20) and actuator element (44) co-operating to open and close an outlet opening (**26*b*) of the outflow passage (26) which is formed in the end side of the plug (20) pointing away from the piston (18) through a displacement of the actuation element (44**).

9. Injection apparatus as claimed in claim 1 wherein the plug (20) comprises a plugging section (**20*a*) which is provided with the supply passage (24) and the outflow passage (26) and which is arranged in a piston region (16*a*) in which the piston (18) is displaceably journalled and is held in the control passage (16) by friction, with the plugging section (20*a*) having at its end pointing away from the piston (18) a holder section (20*b*) which is provided with an outlet opening (26*b*) of the outflow passage (26) and which is arranged in an actuation region (16*a*) of the control passage (16) with a cross-section which is enlarged relative to its piston region (16*a***).

10. Injection apparatus as claimed in claim 1 wherein the flow cross-section of the supply passage (24) has a widening between a supply chamber (32) and the pressure chamber (22) and the outflow passage (26) has a throttle point (**26*c*) ahead of an actuation chamber (46**) in the direction of flow.

11. Injection apparatus as claimed in claim 1 wherein the control unit (18, 20, 28, 44) is designed in such a manner that after the retraction of the interruption of the flow through the outflow passage (26) for the opening of the injection nozzle (10, 11, 14) a force which moves the piston (18) towards the plug (20) is effective, with the axial distance between the piston (18) and the plug (20) as well as the frequency and the amplitude of oscillations of the piston (18) about an equilibrium position being dependent on the geometry of the pressure chamber (22) in an equilibrium position of the piston (18), said geometry including the ratio of the flow cross-sections in the region of the outlet opening (**24*a*) of the supply passage (24) and an inlet opening (26*a*) of the outflow passage (26), the axial distance of the outlet opening (24*a*) and the inlet opening (26*a*) in each case from an end side (38) of the piston (18) facing the plug (20**).

12. Fuel injection apparatus comprising at least one injection nozzle (10, 11, 14) which is connected to a fuel pressure line (12) and which has a nozzle element (14) which can be actuated through an electrically actuable control unit (18, 20, 28, 44) for the opening and the closing of the injection nozzle (10, 11, 14), with the control unit (18, 20, 28, 44) comprising a piston (18) displaceably journalled in a control passage (16), and coupled at one end to the nozzle element (14) and which bounds with an outer end together with a plug (20) which is arranged in the control passage (16), a pressure chamber (22) which can be connected to the fuel pressure line (12) via a supply passage (24) and communicates with an outflow passage (26), wherein the supply passage (24) and the outflow passage (26) in each case open into the pressure chamber (22) at an end side of the plug (20) facing the piston (18) at regions which have a different axial distance from an end side (38) of the piston (18) facing the plug (20), whereby, for the actuation of the nozzle element (14) when the pressure chamber (22) is connected via the supply passage (24) to the fuel pressure line (12), the pressure in the pressure chamber (22) is varied through the release or the interruption of the flow through the outflow passage (26), and whereby a displacement of the piston (18) as a result of a pressure change in the pressure chamber (22) influences the flow through the supply passage (24) into the pressure chamber (22) and the flow out of the pressure chamber (22) into the outflow passage (26).

13. Injection apparatus in accordance with claim 12, wherein the injection nozzle (10, 11, 14) is connected via a supply line (34) to the fuel pressure line (12) and is connected up to an outflow line (36), with the supply passage (24) being connected up to the supply line (34) and the outflow passage (26) to the outflow line (36).

14. Injection apparatus as claimed in claim 12, wherein a supply line (34), an outflow line (36) and the control passage (16) are formed in a connector piece (28).

15. Injection apparatus as claimed in claim 12 wherein the supply passage (24) extends at least region-wise at an inclination to the longitudinal axis of the plug (20), which coincides with a longitudinal axis (30) of the control unit (18, 20, 28, 44), through the plug (20) and preferably opens into an inlet chamber which is formed in the plug (20) and which communicates with a supply line (34).

16. Injection apparatus as claimed in claim 12 wherein the outflow passage (26) extends in the axial direction through the plug (20), with the longitudinal axis of the outflow passage (26) coinciding with the longitudinal axis of the plug (20).

17. Injection apparatus as claimed in claim 12 wherein the outflow passage (26) opens into the pressure chamber (22)

in the region of a central extension (40) having a circular cross-section and the supply passage (24) opens into the pressure chamber (22) at an annular region of an end side of the plug (20) facing the piston (18) which is stepped below to the extension (40) and which surrounds the extension (40).

18. Injection apparatus as claimed in claim 12 wherein an end side of the plug (20) pointing away from the piston (18) and an actuation element (44) which is displaceably journalled in the control passage (16) bound an actuation chamber (46) which communicates with an outflow line (36) for the injection nozzle (10, 11, 14), with the outflow passage (26) opening into the actuation chamber (46) and with the plug (20) and actuator element (44) co-operating to open and close an outlet opening (26*b*) of the outflow passage (26) which is formed in the end side of the plug (20) pointing away from the piston (18) through a displacement of the actuation element (44).

19. Injection apparatus as claimed in claim 12 wherein the plug (20) comprises a plugging section (20*a*) which is provided with the supply passage (24) and the outflow passage (26) and which is arranged in a piston region (16*a*) in which the piston (18) is displaceably journalled and is held in the control passage (16) by friction, with the plugging section (20*a*) having at its end pointing away from the piston (18) a holder section (20*b*) which is provided with an outlet opening (26*b*) of the outflow passage (26) and which is arranged in an actuation region (16*a*) of the control passage (16) with a cross-section which is enlarged relative to its piston region (16*a*).

20. Injection apparatus as claimed in claim 12 wherein the flow cross-section of the supply passage (24) has a widening between a supply chamber (32) and the pressure chamber (22) and the outflow passage (26) has a throttle point (26*c*) ahead of an actuation chamber (46) in the direction of flow.

21. Injection apparatus as claimed in claim 12 wherein the control unit (18, 20, 28, 44) is designed in such a manner that after the retraction of the interruption of the flow through the outflow passage (26) for the opening of the injection nozzle (10, 11, 14) a force which moves the piston (18) towards the plug (20) is effective, with the axial distance between the piston (18) and the plug (20) as well as the frequency and the amplitude of oscillations of the piston (18) about an equilibrium position being dependent on the geometry of the pressure chamber (22) in an equilibrium position of the piston (18), said geometry including the ratio of the flow cross-sections in the region of the outlet opening (24*a*) of the supply passage (24) and an inlet opening (26*a*) of the outflow passage (26), the axial distance of the outlet opening (24*a*) and the inlet opening (26*a*) in each case from an end side (38) of the piston (18) facing the plug (20).

* * * * *